United States Patent [19]

Wagner

[11] Patent Number: 4,944,968

[45] Date of Patent: Jul. 31, 1990

[54] PLACEMAT WITH CHANGEABLE CARD DISPLAY

[76] Inventor: Eugene Wagner, 3424 Kingsbridge Ave., Bronx, N.Y. 10463

[21] Appl. No.: 407,195

[22] Filed: Sep. 14, 1989

[51] Int. Cl.[5] ..... G09F 1/10

[52] U.S. Cl. ..... 428/13; 40/159; 428/542.4; 428/904.4

[58] Field of Search ..... 428/13, 542.4, 904.4; 40/152, 158.1, 159

[56] References Cited

U.S. PATENT DOCUMENTS

| | | | |
|---|---|---|---|
| 1,356,892 | 10/1920 | Stevens | 40/159 |
| 3,920,870 | 11/1975 | Ackerman et al. | 428/46 X |
| 4,083,137 | 4/1978 | Rozmanith | 428/13 X |
| 4,170,303 | 10/1979 | Nolan | 206/557 |
| 4,263,357 | 4/1981 | Holson | 428/12 X |
| 4,617,215 | 10/1986 | Telesco | 428/43 |
| 4,771,557 | 9/1988 | Bowman | 40/159 X |
| 4,829,691 | 5/1989 | Manjos et al. | 40/152 X |
| 4,860,468 | 8/1989 | Cliborn | 40/159 X |

OTHER PUBLICATIONS

The reference discloses indicia imprinted on frangible portions of a placemat.

Reference discloses placemat with removable coupons.

*Primary Examiner*—Henry F. Epstein

*Attorney, Agent, or Firm*—Natter & Natter

[57] ABSTRACT

The placemat includes a panel having an array of clear plastic film pockets each dimension to accomodate available cards bearing the likeness of celebrities such as athletes. Each pocket includes a slot for inserting or removing cards. The panel is imprinted with indicia coordinated with the sports activity of the athletes depicted in the cards selected to be inserted in the various pockets. The pockets may be individually secured to the panel or may be formed of a single sheet which is overlayed over the entire panel.

15 Claims, 2 Drawing Sheets

PLACEMAT WITH CHANGEABLE CARD DISPLAY

BACKGROUND OF THE INVENTION

1. Field of the Invention

This invention relates generally to placemats and more particularly to placemats for use by children and youth.

2. History of the Invention

For generations, children have purchased, collected and traded cards bearing depictions of sports heroes. With each new sports season, thousands of new cards were published while selected cards of the prior seasons became part of treasured collections. Some old cards have truly become collection items and have commanded sales prices in the thousands of dollars.

Trading and collecting cards has been a favorite pass time of children with parents handing down their collections to offspring. While card collecting has been considered a hobby to be encouraged, some children and youth tended to be both disorganized and untidy. Their collections, often numbering hundreds of cards, were frequently disorganized and scattered. Parents have recognized a need for providing devices for storing and possibly sorting their childrens' card collections. Further, children have often desired to coordinate cards of selected players, for example, players on a particular team, or have fashioned their own "all star" team of favorite players from different teams.

Many parents have also appreciated the need for promoting a relaxed atmosphere at meal times for both digestive health purposes and their own mental well being.

SUMMARY OF THE INVENTION

In compendium, the present invention comprises a dining table placemat which includes a plurality of pockets, each suitable to accommodate an available celebrity card, the pockets are preferably formed of clear plastic liquid impervious film and are mounted to an upper panel of the placemat without obscuring printed or painted indicia appearing on the upper panel.

Preferably, the indicia appearing on the upper panel of the placemat is coordinated with the theme or activity of the celebrities depicted on the cards. For example, if the cards carry the depiction of baseball players, the indicia appearing on the panel will comprise baseball related indicia. Should the cards carry the likeness of characters in a popular movie, the indicia may comprise a typical scene or environment of the movie story.

Each of the pockets includes a slot which permits a child to insert and remove selected cards and the clear plastic film of the pockets permits viewing of the cards while preventing damage which might otherwise be occasioned due to food spills and the like.

The pockets may be secured to the upper panel by a transparent pressure sensitive adhesive, by induction welding, ultrasonic welding, heat sealing or other conventional techniques. Alternately, the pockets are be formed of a single sheet which is overlayed on the entire upper panel of the placemat.

From the foregoing compendium, it will be appreciated that it is an aspect of the present invention to provide a placemat with a changeable card display which is not subject to the disadvantages of the history of the invention aforementioned.

It is a consideration of the present invention to provide a placemat with a changeable card display of the general character described which is low in cost and suitable for economical mass production fabrication.

A further aspect of the present invention to provide a placemat with a changeable card display of the general character described which promotes tidiness in children.

A feature of the present invention is to provide a placemat with a changeable card display of the general character described which is well adapted to relieve stressful events at mealtimes.

Another feature of the present invention is to provide a placemat with a changeable card display of the general character described which protects childrens' trading cards from damage while providing a functional meal time attribute.

A further consideration of the present invention is to provide a placemat with a changeable card display of the general character described which includes a plurality of pockets for carrying selected childrens' trading cards.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations are attained all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENTS

Figure 1:
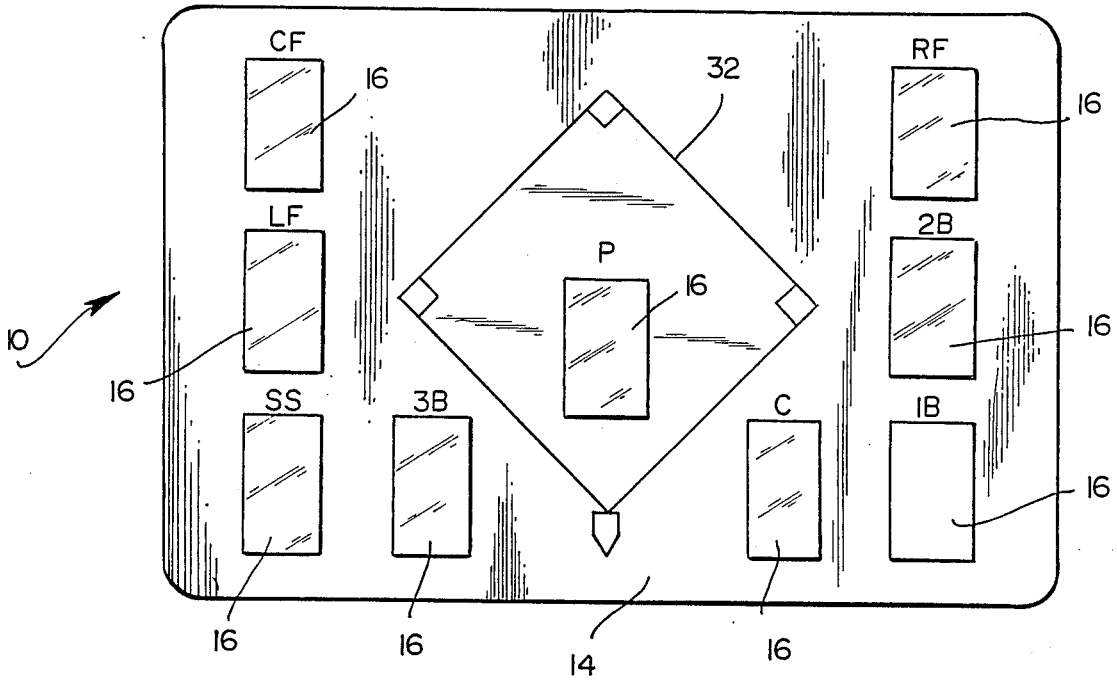
FIG. 1 is a plan view of a placemat constructed in accordance with and embodying the invention and showing a plurality of pockets each adapted to carry a card bearing the depiction of a baseball player.

Referring now in detail to the drawings, the reference numeral 10 denotes generally a placemat with a changeable card display constructed in accordance with and embodying the invention. The placemat 10 is dimensioned to be positioned at a dining area and is suitable for the placement of dining utensils and dishes in a conventional place setting array. The placemat 10 may be formed in a conventional manner as a laminate which includes a foam or other suitable base layer 12 which has a relatively high coefficient friction to reduce slipping. An upper panel 14 is preferably bonded or otherwise laminated to the base layer 12. The upper panel may be formed of a suitable thermoplastic. The structure of the placemat 10 comprising the base layer 12 and upper panel 14 as far as herein described, is basically of conventional design.

Figure 2:
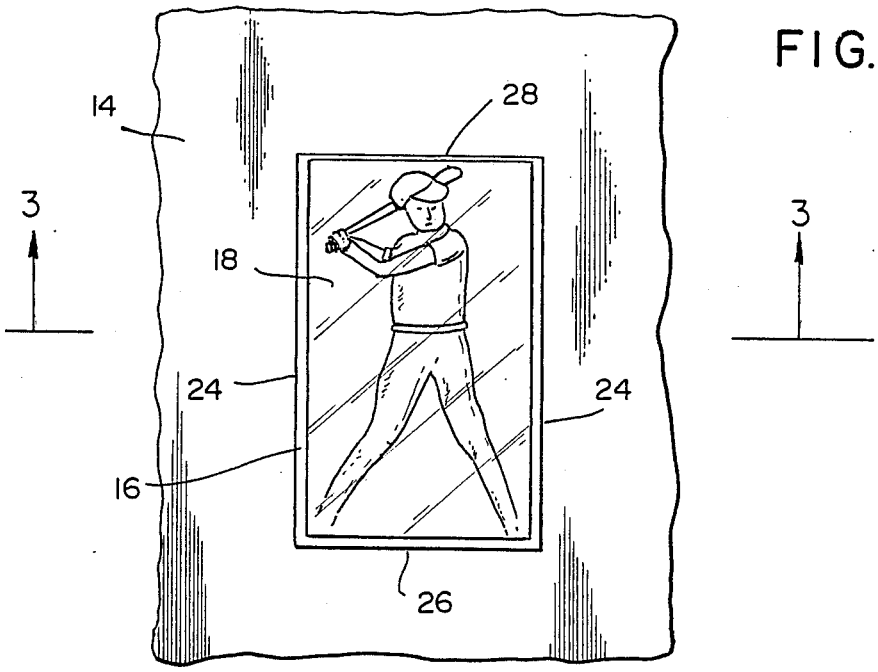
FIG. 2 is an enlarged scale fragmentary plan view of a portion of the placemat and showing a single pocket carrying a selected card.
Figure 3:
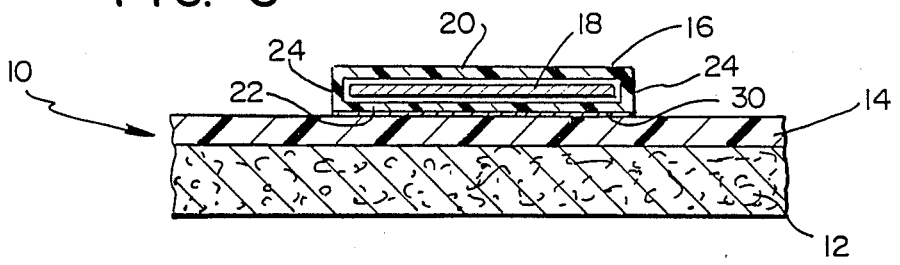
FIG. 3 is an enlarged scale fragmentary sectional view through the placemat, the same being taken substantially along the line 3—3 of FIG. 2.

In accordance with the present invention, however, bonded or otherwise secured to the upper panel 14 is an array of pockets 16 each suitable for carrying a rectangular celebrity card 18. With reference now to FIGS. 2 and 3 wherein a typical pocket 16 is illustrated, it will be noted that the pocket 16 comprises an envelope or sleeve formed of an upper face 20 of generally rectangular configuration having a width and heighth which is greater than the width and heighth of the celebrity cards 18. In addition, the pocket 16 also includes a lower face 22 which is registered with the upper face and joined thereto in unitary fashion along opposed longitudinal sides 24 as well as a lower end 26. Along the top edge of the upper and lower faces 20, 22, an opening or slot 28 is provided for the purpose of insertion and removal of selected celebrity cards 18. The longitudinal sides 24 serve to maintain the upper face 20 spaced from the lower face 22 to facilitate insertion of a celebrity card 18 through the slot 28.

The pockets 16 are mounted to the surface of the upper panel 14 of the placemat 10 by a layer of conventional transparent pressure sensitive adhesive, such as the adhesive employed to mount decals for viewing through window surfaces. It should be noted, however, that the layer of adhesive 30 need not be transparent since the depictions on the celebrity cards 18 are viewable through the upper face 20 of the pockets. The pockets 16 are preferably formed of liquid impervious clear thermoplastic film.

In accordance with the invention, each placemat constructed in accordance with the present invention will be prededicated to cards bearing depictions of celebrities of a particular subject or field, such as, for example, baseball, football, basketball or other sports activity or possibly celebrities from a popular movie. In each instance, the upper panel 14 of the placemat will preferably include suitable indicia 32 such as, for example, a baseball diamond. If, for example, the celebrity cards bear the likeness of characters from a popular movie, the indicia 32 will comprise a scene or illustration relating to the theme of the movie.

As illustrated in FIG. 1, wherein the indicia 32 comprises baseball related indicia, nine pockets 16 representing the nine players on a baseball team are mounted to the upper panel 14. The indicia 32 may also comprise playing position indicia positioned adjacent the slots 28 of each pocket for indicating the playing position of the player depicted on the cards selected for insertion into the respective slots.

As will be appreciated from an examination of FIG. 1, a sufficient open surface area free of pockets is provided on the upper panel 14. The indicia is positioned on the open surface area which preferably occupies approximately 50% of the total surface area of the upper panel 14 however, it should be appreciated that appropriate visual effects may be obtained with the indicia occupying a wide range of open surface areas.

Figure 4:
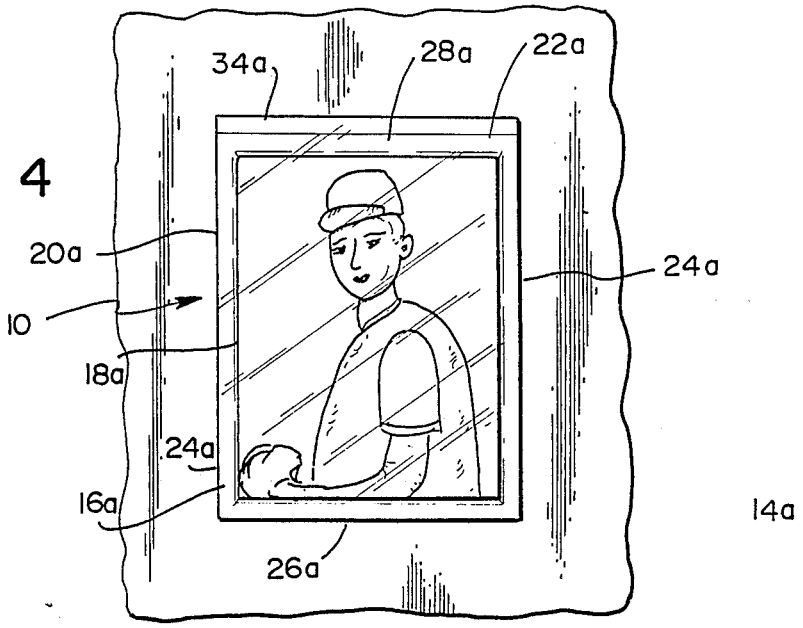
FIG. 4 is an enlarged scale fragmentary plan view of an alternate embodiment of the placemat wherein a lip is provided to protect the cards and assist in insertion and removal of cards.

In FIG. 4, an alternate embodiment of pocket construction is illustrated, such construction being similar to the embodiments of FIGS. 2 and 3. Like numerals have been employed to denote like components of the embodiment previously described, however bearing the suffix "a".

In this embodiment, a pocket **16*a* is substantially identical to the pocket 16 previously described, however, in order to facilitate insertion and removal of selected celebrity cards 18*a*, and assure that food spills will not enter pocket 16*a*, a lower face 22*a* is shorter than an upper face 20*a* to provide a lip 34*a* covering and leading to a slot 28*a***.

Figure 5:
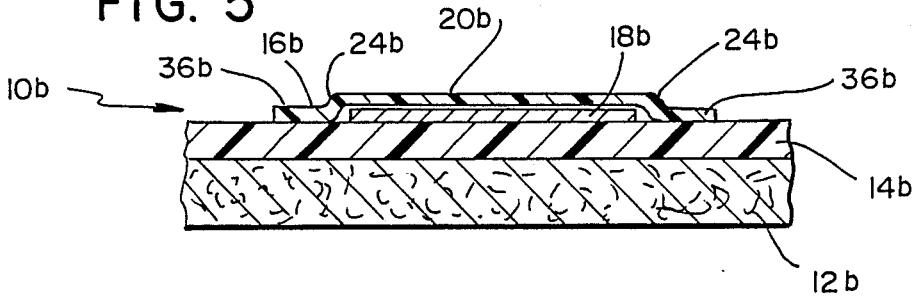
FIG. 5 is an enlarged scale fragmentary sectional view through a placemat of an alternate embodiment wherein the pockets are formed of a single layer.

Turning now to a further embodiment of the invention illustrated in FIG. 5, wherein like numerals are employed to denote like components of the embodiments previously described, however bearing the suffix "b", a pocket **16*b* is formed of a single face 20*b* of clear thermoplastic film having a generally rectangular central section which is offset from a peripheral flange 36*b* which extends along a pair of parallel longitudinal sides 24*b* and across a lower end. A slot is provided along the upper end for insertion and removal of celebrity cards 18*b***.

The peripheral flanges **36*b* may be secured to the upper panel 14*b* of a placemat 10*b* by conventional techniques such as ultrasonic welding, heat sealing, solvent welding, or a layer of transparent adhesive such as the adhesive utilized in conjunction with the embodiments of FIGS. 2, 3, and 4**.

Figure 6:
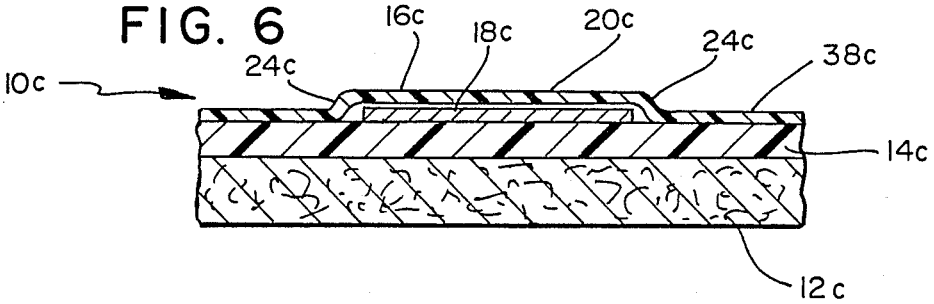
FIG. 6 is an enlarged scale fragmentary sectional view through a placemat of a further embodiment wherein a plurality of pockets are formed of a single sheet.

Turning now to FIG. 6 where a still further embodiment of the invention is shown, like numerals will be employed to denote like components of the previous embodiments, however, bearing the suffix "c". In this embodiment, a placemat **10*c* is formed of a base layer 12*c* and an upper panel 14*c*. A plurality of pockets 16*c* are formed of a single sheet 38*c* of clear thermoplastic film, which overlays the entire upper panel 14*c*. Each pocket 16*c* includes a substantially rectangular planar upper face 20*c* which is upwardly offset from the plane of the sheet 38*c*. The sheet 38*c* is suitably bonded to the upper panel 14*c* of the placemat 10*c*. A transparent bond is provided so that indicia imprinted on or applied to the surface of the upper panel 14*c* remains visible through the sheet 38*c***.

The upper face **20*c* of each of the pockets 16*c* is bounded by a pair of parallel longitudinal sides 24*c* and a bottom or lower end, which extend between the upper face 20*c* and the sheet 38*c*. A space or slot is provided along the upper end of the upper face 20*c* to permit insertion and removal of selected celebrity cards 18*c***.

As previously mentioned, the pockets as well as the entire surface of the upper panel 14, (if exposed), are all formed of liquid impervious thermoplastic which will not absorb liquid spills and, serves to protect the celebrity cards which are displayed in the individual pockets. As a result, should a spill occur or cleansing be necessary, they may be easily wiped with a damp cloth or sponge without injuring the cards.

As can be readily appreciated, placemats constructed in accordance with the invention are custom decorated by children or youth, and foster collection and organizational traits in children.

Thus, it will be seen, that there is provided a placemat with changeable card display which achieves the various aspects, features and considerations of the present invention and which is well adapted to meet the conditions of practical usage.

As various changes might be made in the placemat with a changeable card display as above set forth, it is to be understood that all matter herein described or shown in the accompanying drawings is to be interpreted as illustrative and not in a limiting sense.

Having thus described the invention there is claimed as new and desired to be secured by Letters Patent:

1. A display mat for carrying a plurality of display cards, the mat comprising a pliant panel, the panel being dimensioned with a surface area greater than the combined surface area of a plurality of cards, the panel including a like plurality of pockets, each pocket including a substantially rectangular face and further face each having four peripheral edges, means mounting each pocket to the panel in a predetermined array, the panel including an open surface area free of pockets, means for closing each pocket along three peripheral edges and means associated with a fourth peripheral edge of each pocket for insertion and removal of cards into and out of the pocket, the face of each pocket being formed of a transparent, liquid impervious pliant layer of thermoplastic material, the panel being dimensioned with a total surface area greater than the combined surface area of the plurality of pocket faces leaving at least 30% of the total panel surface area as the open surface area free of pockets.

2. A display mat for displaying cards as constructed in accordance with claim 1 wherein the means mounting the pockets of the panel includes a transparent adhesive layer positioned between the further face and the panel.

3. A display mat for displaying cards as constructed in accordance with claim 1 wherein the first mentioned face extends beyond the further face at the fourth peripheral edge of the pocket, a slot being positioned adjacent the fourth peripheral edge.

4. A display mat for displaying cards as constructed in accordance with claim 1 wherein each card bears the depiction of a celebrity, the mat further including indicia relating to the subject of the celebrities depicted on the celebrity cards, the indicia being carried on the open surface area of the panel.

5. A display mat for displaying celebrity cards as constructed in accordance with claim 4 wherein the celebrity cards comprise baseball cards, the indicia comprising a depiction of a baseball scene.

6. A display mat for displaying cards as constructed in accordance with claim 1 wherein the means for closing the pocket along three peripheral edges of the face comprises a peripheral flange and the means for mounting the pocket to the panel includes means for joining the pocket to the panel at the peripheral flange.

7. A display mat for displaying cards as constructed in accordance with claim 6 wherein the peripheral flange is heat sealed to the panel.

8. A display mat for displaying cards as constructed in accordance with claim 6 wherein the peripheral flange is joined to the panel by solvent welding.

9. A display mat for displaying cards as constructed in accordance with claim 6 wherein the peripheral flange is joined to the panel by adhesive.

10. A display mat constructed in accordance with claim 4 wherein the celebrity cards depict celebrities of a particular sport, the plurality comprising the number of players of one team permitted to engage in play of the sport at one time.

11. A display mat for displaying cards as constructed in accordance with claim 1 wherein the panel includes a foam base layer.

12. A display mat for displaying cards as constructed in accordance with claim 1 wherein the mat comprises a placemat, the panel being dimensioned for placement on a dining surface and for accommodating a place setting.

13. A system for organizing and displaying a plurality of rectangular celebrity cards, each card including indicia comprising a depiction of a celebrity, the system including a plaint panel, the panel carrying indicia, the indicia comprising a scene associated with the celebrities depicted on the celebrity cards, the panel further including a plurality of display pockets, means mounting the pockets to the panel in a predetermined array, the panel being dimensioned with a total surface area substantially greater than the combined surface area of the pockets leaving an open surface area free of pockets, the indicia being carried on the open surface area, each pocket including means for removably carrying a celebrity card, each pocket including a transparent, liquid impervious, rectangular, front face and a further face, means for closing the faces along three peripheral edges of the faces for preventing inadvertent removal of celebrity cards and slot means associated with a fourth peripheral edge of the faces, the slot means for accessing the pocket to insert and remove celebrity cards.

14. A system for organizing and displaying a plurality of celebrity cards as constructed in accordance with claim 13 further including a celebrity card carried in each pocket, each celebrity card depicting the likeness of a sports celebrity associated with one particular sport, the scene comprising a representation of a playing environment associated with the sport of the sports celebrities depicted on the cards.

15. A system for organizing and displaying a plurality of celebrity cards as constructed in accordance with claim 14 wherein the sports celebrities comprise baseball players, the scene comprising a representation of a baseball field, the panel including nine pockets, representing nine players of a baseball team.

* * * * *